United States Patent [19]

Ledford et al.

[11] Patent Number: 4,808,188

[45] Date of Patent: Feb. 28, 1989

[54] POLYESTER FIBERS, YARNS AND FABRICS WITH ENHANCED HYDROPHILICITY AND METHOD OF PRODUCING SAME WITH BOROHYDRIDE ANIONS AND LITHIUM CATIONS

[76] Inventors: W. Troy Ledford, 2201 Linda St.; John R. Wasson, 3101 Gardner Park Dr., both of Gastonia, N.C. 28052

[21] Appl. No.: 198,117

[22] Filed: May 24, 1988

Related U.S. Application Data

[63] Continuation-in-part of Ser. No. 97,535, Sep. 16, 1987, abandoned, which is a continuation of Ser. No. 822,776, Jan. 27, 1986, abandoned.

[51] Int. Cl.[4] ..... D06M 9/00; C08F 20/00

[52] U.S. Cl. ..... 8/115.68; 8/115.65; 8/115.66; 8/115.69; 525/426; 525/437

[58] Field of Search ..... 8/115.68, 115.65, 115.66, 8/115.69

[56] References Cited

U.S. PATENT DOCUMENTS

| | | | |
|---|---|---|---|
| 2,590,402 | 3/1952 | Hall et al. | 8/115.69 |
| 2,597,557 | 5/1952 | Amborski | 8/115.68 |
| 2,781,242 | 2/1957 | Knapp | 8/115.69 |
| 2,998,296 | 8/1961 | Hennemann | 8/115.69 |
| 3,297,786 | 1/1967 | Horowitz | 525/426 |
| 3,400,187 | 9/1968 | Farrow | 264/137 |
| 3,418,066 | 12/1968 | Caldwell et al. | 8/115.62 |
| 3,460,896 | 8/1969 | Caldwell | 8/115.69 |
| 3,654,679 | 4/1972 | Meneghini et al. | 8/114.6 |
| 3,795,482 | 3/1974 | Yelin et al. | 8/115.69 |
| 3,837,798 | 9/1974 | Yelin et al. | 8/115.69 |

FOREIGN PATENT DOCUMENTS

| | | |
|---|---|---|
| 51-030895 | 3/1976 | Japan . |
| 53-147898 | 12/1978 | Japan . |
| 57-191382 | 11/1982 | Japan . |
| 58-079028 | 5/1983 | Japan . |

OTHER PUBLICATIONS

Sanders et al, J. Applied Polymer Science, 1982, vol. 27, pp. 4477–4491.

Olson et al, AATCC Journal, 1984, vol. 16 (No. 2), pp. 48/35–54/41.

Zeronian et al., J. of Industrial Fabrics, 1984, vol. 3 (No. 2), pp. 19–29.

Ellison et al, J. Applied Polymer Science, 1982, vol. 27, pp. 247–257.

*Primary Examiner*—A. Lionel Clingman

*Attorney, Agent, or Firm*—Bell, Seltzer, Park & Gibson

[57] ABSTRACT

The present invention relates to products with enhanced hydrophilicity produced by treating polyester materials such as fibers, yarns and fabrics with aqueous solutions or dispersions of metal hydrides or complex metal hydrides.

21 Claims, No Drawings

POLYESTER FIBERS, YARNS AND FABRICS WITH ENHANCED HYDROPHILICITY AND METHOD OF PRODUCING SAME WITH BOROHYDRIDE ANIONS AND LITHIUM CATIONS

BACKGROUND OF THE INVENTION

This application is a continuation-in-part of copending application Ser. No. 097,535, filed Sept. 16, 1987, which is a continuation of copending application Ser. No. 822,776, filed on January 27, 1986 and both now abandoned.

This invention relates to the production of polyester materials with enhanced hydrophilicity. More particularly, the invention is concerned with polyester materials such as fibers, yarns and fabrics which have enhanced hydrophilicity and which are produced by treating polyester polymers with metal hydrides.

Due to the inherent hydrophobic nature of polyester fibers, fabrics formed entirely from polyester fibers exhibit relatively poor moisture absorption and release properties. In order to achieve improved comfort in apparel fabrics, the polyester fibers are typically blended with a hydrophilic fiber, such as cotton. It has long been recognized that it would be desirable to improve the wettability of the normally hydrophobic polyester fibers, and several methods have been proposed for enhancing the hydrophilicity of polyester materials, such as for example by preparation of polyester polymers using appropriate hydrophilic comonomers, and the application of hydrophilic polymeric add-on agents or coatings. However, these prior approaches have not been met with widespread acceptance. An inherent problem with hydrophilic add-on chemicals is the lack of permanence. The hydrophilic properties imparted by the add-on chemicals are lost after repeated laundering of the fabrics.

Graft polymerization of hydrophilic vinyl monomers onto hydrophobic substrates has been described in Horowitz U.S. Pat. No. 3,297,786 for use with nylon, polypropylene, polyesters, and other substances. The modification of polyester materials using various oxidizing agents has been described in U.S. Pat. Nos. 3,418,006, 3,795,482, and 3,837,798. Acid treatment of polyester materials has been described in U.S. Pat. Nos. 2,597,557 and 3,460,896. The effect of acid treatment of polyester polymers is reasonably attributed to the acid hydrolysis of the ester linkages.

By contrast, various aspects of the alkaline hydrolysis (caustic leveling or caustic reduction) of polyester materials has been described in U.S. Pat. No. 2,590,402; 2,781,242; 2,828,528; 2,998,296; 3,400,187; 3,654,679; and 4,008,044. The caustic leveling process basically involves the saponification of the ester linkages. Caustic leveling treatment of polyester materials for improved aesthetics is typically associated with a fabric weight loss of from 2–5 percent to as high as about 30 percent, depending upon treatment conditions, and is also typically accompanied by a significant loss in fabric strength.

The treatment process of the present invention imparts greatly enhanced hydrophilicity to polyester materials, and concomitant changes in other properties such as hand, electrical conductivity, flammability, etc. The treatment process does not involve the use of add-on chemicals, but instead effects a molecular change in the polyester material which remains even after repeated laundering and dry cleaning. A further advantage of the treatment process of the present invention is that it can be readily carried out using conventional textile finishing equipment, and it utilizes chemicals which do not require elaborate safety precautions.

SUMMARY OF THE INVENTION

The process of this invention is carried out quite simply by treating the polyester material with a metal hydride.

In one aspect of the invention, the polyester material, in fiber, yarn or fabric form, is treated with a treatment bath containing an aqueous solution or dispersion of metal hydrides. The concentration of the treatment bath and the time and temperature conditions of treatment can be varied as desired depending upon the nature of the polyester material undergoing treatment and the degree of hydrophilicity desired to be imparted to the material. The contacting of the polyester material with the metal hydride solution or dispersion may be suitably carried out by immersion, padding, spraying, or other suitable method. After application of the treatment bath, the fabric may be batched and allowed to stand for a period of time prior to washing and drying, or the fabric may be processed continuously, with optional application of heat or steam to the hydride-impregnated fabric to accelerate treatment.

In another aspect of the invention, the polyester material may be treated with metal hydrides prior to being melted and formed into fibers or other polyester articles. For example, polyester powder or chip may be treated with an aqueous solution or dispersion of metal hydrides, dried and thereafter melted and spun into polyester fibers by melt spinning processes and apparatus of the type conventionally used in forming polyester fibers. Alternatively, the metal hydrides in solid form can be mixed with the polyester powder or chip and the mixture thereafter melted and extruded or spun into polyester fibers.

The treated product may thereafter be processed and finished in the conventional manner, using only the precaution that softeners and any other finishing chemicals added to the treatment fabric should not be highly hydrophobic, since such materials would obviate the benefits of the treatment process.

DESCRIPTION OF PRFERRED EMBODIMENTS

The present invention can be used as an after treatment to impart hydrophilic properties to previously formed polyester materials, or it can be used at an earlier stage to impart hydrophilic properties to fibers at the time they are formed by melt-spinning.

When used as an after treatment, the polyester materials which may be treated by the process of this invention may be in various forms, such as fiber, filament, tow, yarn, thread, fabric, film, and the like. The materials may be formed solely of polyester or may be blended in various proportions with other materials such as cotton, for example. Any of the polyester polymers or copolymers known for use in producing textile fibers may be used in the process of this invention. The polyester polymers may include, among others, linear polyesters of aromatic dicarboxylic acids and dihydric compounds, such as polyethylene terephthalate, modified polyester polymers and copolymers, etc.

The treatment process involves contacting the polyester material with a treatment bath containing an aqueous solution or dispersion of metal hydrides. The time, temperature and treatment bath concentration may be empirically determined depending upon the particular form of the polyester material being treated and the degree of hydrophilicity desired. For example, the treatment solution may be applied at room temperature and the fabric may be left to stand at room temperature for from several hours to a day. Alternatively, the treatment time may be reduced by steaming or by heating in an oven or tenter. The concentration of the metal hydride in the treatment bath may suitably range from about 0.05to about 10 percent by weight.

The term "metal hydrides" are used herein is intended to include both simple metal hydrides, such as lithium hydride, and complex metal hyrides, such as lithium aluminum hydride. Examples of simple metal hydrides and complex metal hydrides which may be useful in the present invention include lithium hydride, sodium borohydride, lithium borohydride, zinc borohydride, and lithium aluminum hydride. Depending upon the nature and stability of the particular materials, they may be dissolved or dispersed either in water or in a suitable nonaqueous solvent.

A preferred method of treating polyester fabric and yarn is to pad an aqueous solution containing about 0.3 percent by weight of sodium borohydride and about 0.9 percent by weight of lithium hydroxide, to the extent of about 135 percent wet pickup onto the greige polyester material and to run the thus impregnated material through a dryer at about 350° F. (177° C.) with a retention time of about one minute. The thus treated material is then rinsed with water and then subjected to further standard processing. The material thus treated has enhanced hydrophilicity and an improved hand or silky feel. The hydrophilicity may be readily measured by a simple drop test in which a drop of water is applied to a fabric and the time it takes to be absorbed by the fabric determined or, alternately, measured by the rate at which water ascends a fiber or fabric swatch. This borohydride approach works excellently on laboratory and production scales and requires no special equipment other than that normally encountered in textile processing. The treating solution may be augmented with about 0.3–1.0 weight percent of lithium chloride or about 0.3 percent of an aliphatic amine such as ethylenediamine, if desired. Preferably, the treatment solution has a pH of greater than 7.

Another method of treating polyester materials is to immerse them in more concentrated versions of the aqueous $LiOH/NaBH_4$ or $LiOH/NaBH_4/LiCl$ solutions at room temperatures for varying lengths of time. Immersing polyester fabrics in an aqueous solution containing about 3 percent sodium borohydride and 8.1 percent lithium hydroxide for 12 hours at room temperature and then washing them with water or a water/isopropanol mixture results in fabrics with enhanced hydrophilicity. Lithium salts compatible with the sodium borohydride, such as lithium chloride, may be added to the treating solution to augment the effects.

It will be appreciated that concentration of the metal hydride in the aqueous treatment solution and the concentration of the lithium hydroxide may be varied over a wide range depending upon the time and temperature conditions of treatment. For example, the sodium borohydride may be suitably employed at concentrations ranging from about 0.05 to about 10 percent by weight, and the lithium hydroxide at concentrations of from about 0.1 to 15 percent by weight. The treatment time and temperature and treatment bath concentration should be selected to avoid degradation of fabric physical properties.

While the exact mechanism has not been confirmed, and no specific theory is relied upon herein, it is believed that the process which occurs when the above-noted aqueous lithium hydroxide/sodium borohydride treatment bath is used involves the association of lithium ions with the borohydride anion to form an in situ lithium borohydride species which can reduce the ester units to alcohols, perhaps as given in Equation 1.

$$-R-\overset{\overset{\displaystyle O}{\|}}{C}-O-R^1- + LiBH_4 \longrightarrow -R-CH_2-OH + HO-R^1- + LiBO_2 \quad (1)$$

Lithium borohydride has been shown to reduce esters whereas sodium borohydride gives only moderate reaction over a long time period. The enhanced wicking rate or hydrophilicity of polyester fabric treated with the borohydride solution containing added lithium chloride could be due to the increased amount of in situ lithium borohydride generated by the equilibrium association given by the unbalanced Equation 2.

$$LiCl + LiOH + NaBH_4 + > LiBH_4 \rightarrow Na^+ + Cl^- - + OH^- \quad (2)$$

according to the Principle of Le Chatelier. Alternately, the effect of the added lithium chloride could be simply due to an enhanced swelling of the polymer brought on by the lithium chloride. Lithium chloride remaining on the fabric after treatment is unlikely since the fabric is rinsed after treatment. Presumably, any aldehyde intermediates generated in Equation 1 would be readily reduced by either $LiBH_4$ or $NaBH_4$ in solution. The reaction described by Equation 1 is general for any ester linkage whether in a monomer or a polymer. Hence, this invention works on the common polyethylene terephthalate (PET) and other ester polymers. It is noted that traces of transition metal ions, used deliberately or present in the water employed in the reaction described by Equation 1, can catalyze the reaction.

Another facet of this invention involves the use of metal hydrides and complex metal hydrides in treating polyester powder or chip prior to melt-spinning the polyester into fibers. The metal hydrides or complex metal hydrides can be mixed with the polyester chip or powder and melted, or the polyester powder or chip can be treated with an aqueous solution of the metal hydrides or complex metal hydrides, dried and then melt-spun.

Still another facet of this invention involves the use of metal hydrides and complex metal hydrides in organic solvents for the reduction of polyester linkages, e.g., lithium hydride or lithium aluminum hydride in tetrahydrofuran or other ethers. In situations in which the hydrides are not highly soluble in the appropriate solvent, dispersions involving the slightly soluble hydride can be employed. In the organic solvent systems various metal salts can be used to catalyze the reduction reactions.

The examples which follow are intended to illustrate the practice and principles of this invention and a mode for carrying out the invention, but are not to be understood as limiting the present invention.

EXAMPLE 1

A 10 g scoured swatch of woven 100% polyester fabric was dipped into an aqueous solution containing 3% by weight of sodium borohydride and 8% lithium hydroxide. The swatch was wrung out by hand (using latex glove protection) and placed in the top pan of a double boiler and heated for thirty minutes. The swatch was removed, washed throughly with water and dried at room temperature. A drop of water applied to the treated swatch was absorbed very quickly whereas an untreated control swatch retained a bead of water for 45 seconds.

EXAMPLE II

The procedure of Example I was repeated with an addition of 1% ethylenediamine to the sodium borohydride, lithium hydroxide solution. A drop of water applied to the treated swatch was absorbed instantly whereas an untreated control swatch retained a bead of water for 45 seconds.

EXAMPLE III

An addition of 3% lithium chloride was made to the solution employed in Example I. The water drop test results were the same as observed in Example II.

EXAMPLE IV

Both 3% lithium chloride and 1% ethylenediamine were added to the solution employed in Example I. The water drop test results were the same as observed in Example II.

EXAMPLE V

Example I was repeated using a standard microwave oven for heating the sample contained in a plastic bag for 30 seconds after application of the sodium borohydride, lithium hydroxide solution. The treated fabric sample showed enhanced wicking rate as compared to Example I.

EXAMPLE VI

A five pound sample of 100% polyethylene terephthalate filament yarn was prewashed in a Gaston County Lab Sample Dye Machine with 0.5% caustic and 1% nonionic detergent to remove any winding emulsions and fiber lubricants which might be present. The scoured and undried yarn was then impregnated with 6% of a stock solution containing 3.75% sodium borohydride and 8.0% lithium hydroxide monohydrate. The impregnated yarn was heated at 212° F. (100° C.) for thirty minutes. The yarn was then given a running wash for ten minutes, extracted and dried in a Gaston County lab package dryer. The wicking properties of treated and untreated yarns were compared by placing strands in a beaker of water observing the wicking rate. The treated material wicked water rapidly whereas the untreated yarn did not wet.

EXAMPLE VII

A sample of 600 pounds of 100% polyethylene terephthalate spun fiber tubular knit innerlock fabric which had been previously scoured or washed with ½% caustic and 1% nonionic detergent to remove soil and knitting oils was padded through a treating solution (0.375% sodium borohydride and 1.0% lithium hydroxide monohydrate) at 135% wet pick up on a Tube Tex finishing pad. The fabric was then folded up and taken to a three stage dryer where it was dried (first stage 350° F., second stage—300° F., third stage—250° F.) to dryness. The total dwell time in the dryer was 60 seconds. The treated fabric was then loaded into a Gaston County Jet Machine and washed two times with cold water. The fabric was then dyed red by standard methods with disperse dye at 265° F. for one hour, washed and unloaded. The fabric was then finished with a 1% solution of a commercially available low molecular weight softener for polyester, using a wet on wet padding method. The finished goods were then dried at 250° F. in a Tube Tex dryer. Goods were then run through a Fabcon calender and rolled up, bagged and prepared for shipping. The fabric exhibited a smooth silky soft hand similar to a knitted cotton fabric, and absorbed water droplets almost instantly. When the same water drop test was performed on an untreated (control) fabric, the drop took more than 5 minutes to be absorbed into the fabric.

Example VIII

The fire retardant characteristics of the fabric produced in Example VII were evaluated using the Seam Flammability Test. Duplicate seams were made joining two pieces of the fabric with both a spun polyester thread and a textured thread. Each seam was then subjected to a flame in accordance with the procedure used for testing children's sleepwear up to size 6X. In both instances the flame was quickly self-extinguished after spreading about an inch parallel to the stitching. These tests indicate that the fabric was effectively treated to self-extinguish a flame. By comparison, conventional fabrics without any flame retardant treatment burn three to five times this length.

EXAMPLE IX

Approximately 2 g of lithium hydride, LiH, was dispersed in 250 ml of tetrahydrofuran. The mixture was shaken and an 11"×10" swatch of 100% polyester knit fabric (similar to that used in Example VII) was immersed in it for a 16 hour period at ambient temperature in a closed flask. The reaction mixture was removed and the fabric rinsed with isopropanol and thoroughly washed with hot water and dried. The resultant fabric had a silky feel and absorbed water instantly when it was applied with an eye dropper.

EXAMPLE X

Approximately 2 g of lithium aluminum hydride, $LiAlH_4$, was dispersed in 300 ml of tetrahydrofuran and a swatch of 100% polyester knit fabric (similar to that used in Example VII) was immersed and treated in accordance with the procedures of Example IX, except for the swatch being washed with 10% aqueous ammonium chloride and hot water and dried. The result was similar to that obtained in Example IX but the water absorption was not quite as rapid.

EXAMPLE XI

One kilogram of polyester powder (80% of which passed through a 200 mesh screen) was treated with an aqueous solution (3 liters) containing 30 g of sodium borohydride and 80 g of lithium hydroxide. The reaction mixture was stirred vigorously while the temperature was maintained at 75° C. for 3 hours. The reaction mixture was allowed to cool and the treated polyester powder was recovered by filtration. The polyester powder was washed by dispersing in water several times and re-filtering. Finally, the treated powder was dried for 12 hours at 110° C. Other samples of treated polyester powder were similarly prepared employing varying reaction times and temperatures.

Several grams of the treated polyester powder were placed into a test tube and then heated until the powder melted. The melt was touched with a cool glass rod and a fiber was pulled upon removing the rod from the melt. The fibers so obtained were cut into 6 to 8 inch lengths and hung over the side of a beaker containing distilled water. The other end of the fiber hung over a watch glass to catch the water transferred from the beaker by the fiber. The water transfer rates were determined by counting the number of drops of water falling into the watch glass in a one hour period. In all instances the fibers pulled from the treated polyester powder transferred water 3–10 times more than similar fibers pulled from melted untreated polyester powder. No quantitative correlations between reaction times or temperatures and water transfer rates were established.

EXAMPLE XII

Ten grams of polyester powder were ground with 0.3 g of sodium borohydride and 0.8 g of lithium hydroxide. The mixture was melted and fibers pulled by the method described in Example XI. Ten grams of polyester powder were ground with 0.4 g of sodium hydride, the mixture melted and fibers pulled from the melt. Similarly, 10 g of polyester powder and 0.4 g of lithium aluminum hydride were ground together, melted and fibers pulled from the melt. Water transfer rates, as described in Example XI, were determined. The treated polyester melt-produced fibers which transferred water 3–10 times better than fibers pulled from the untreated polyester melts.

While the invention has been described with particular reference to preferred methods of carrying out its practice, other embodiments will be apparent to those skilled in the art. It is therefore intended to limit the invention only by the scope of the appended claims.

That which is claimed is:

1. A modified polyester polymer having enhanced hydrophilicity which is produced by contacting the polyester with an aqueous treatment bath containing borohydride anions and lithium cations.

2. A modified polyester according to claim 1 wherein the aqueous treatment bath has a pH of greater than 7.

3. A modified polyester according to claim 1 wherein the aqueous treatment bath additionally includes an aliphatic amine or diamine.

4. A modified polyester polymer according to claim 1 in which the treatment bath additionally includes transition metal ions.

5. A modified polyester polymer having enhanced hydrophilicity in which at least some of the ester units of the polyester have been reduced to hydrophilic alcohol groups by contact with a borohydride in the presence of lithium ions.

6. A modified polyester according to claim 5 in which said ester units have been reduced by contact with an aqueous solution of sodium borohydride and lithium hydroxide at a pH of greater than 7.

7. A process of treating polyester polymers to impart enhanced hydrophilicity which comprises contacting the polyester with an aqueous treatment bath containing a borohydride and lithium ions.

8. A process according to claim 7 wherein the treatment bath is an aqueous solution of sodium borohydride and lithium hydroxide at a pH of greater than 7.

9. A process according to claim 8 wherein the treatment bath additionally includes lithium chloride.

10. A process according to claim 8 wherein the treatment bath additionally includes an aliphatic amine or diamine.

11. A process according to claim 8 wherein the treatment bath additionally includes transition metal ions.

12. A process of treating textile materials formed at least partially of polyester to impart enhanced hydrophilicity to the polyester, said process comprising contacting the polyester-containing textile materials with an aqueous treatment bath containing about 0.05 to 10 percent by weight of a borohydride and about 0.1 to 3 percent of a lithium compound for a time and at a temperature sufficient to react with the polyester and impart enhanced hydrophilicity thereto, and thereafter washing and drying the textile materials.

13. A process according to claim 12 wherein the treatment bath contains sodium borohydride and lithium hydroxide at a pH of greater than 7.

14. A process according to claim 12 wherein the step of contacting the textile materials with the aqueous treatment bath comprises padding the treatment bath onto the textile material and heating the thus treated materials.

15. A process according to claim 7 comprising the additional step of melting the thus-treated polyester polymer and forming fibers therefrom.

16. A modified polyester polymer having enhanced hydrophilicity which is produced by contacting the polyester with borohydride anions and lithium cations.

17. A modified polyester polymer according to claim 16 wherein the polyester polymer is in the form of a melt-spun fiber and wherein the polyester polymer is contacted with said borohydride anions and lithium cations before being melted and formed into a fiber.

18. A modified polyester polymer according to claim 16 wherein the polyester polymer is in the form of a melt-spun fiber and is contacted with said borohydride anions and lithium cations after being melted and formed into a fiber.

19. A process of producing treated polyester fibers having enhanced hydrophilicity comprising treating polyester polymer with a metal hydride and melting the treated polyester polymer and forming fibers therefrom.

20. A process according to claim 19 wherein the step of treating polyester fiber with a metal hydride comprises mixing the polyester polymer in powder or chip form with sodium borohydride and lithium hydroxide.

21. A process according to claim 19 wherein the step of treating polyester fiber with a metal hydride comprises contacting the polyester polymer in powder or chip form with aqueous sodium borohydride and lithium hydroxide and thereafter drying the polyester polymer prior to said melting step.

* * * * *